US005961109A

United States Patent [19]

Dykstra et al.

[11] Patent Number: 5,961,109

[45] Date of Patent: Oct. 5, 1999

[54] AMPLIFIED HOLD-DOWN CLAMP

[75] Inventors: Henry Dykstra, Hartland; Douglas D. Colby, Clarkston, both of Mich.

[73] Assignee: Delaware Capital Formation, Inc., Wilmington, Del.

[21] Appl. No.: 09/047,619

[22] Filed: Mar. 25, 1998

[51] Int. Cl.[6] ..... B25B 5/12

[52] U.S. Cl. ..... 269/228; 269/236; 269/196; 269/201

[58] Field of Search ..... 269/228, 201, 269/138, 199, 196, 236

[56] References Cited

U.S. PATENT DOCUMENTS

| | | | |
|---|---|---|---|
| 2,386,567 | 10/1945 | Olson | 269/221 |
| 2,574,281 | 11/1951 | Olson . | |
| 2,815,052 | 12/1957 | Krasnow | 269/236 |
| 3,035,831 | 5/1962 | Blatt | 269/201 |
| 3,872,760 | 3/1975 | Desnoyers, Jr. | 269/228 |
| 3,924,844 | 12/1975 | Bachtel, Jr. | 269/228 |
| 4,887,803 | 12/1989 | Witt . | |
| 4,958,813 | 9/1990 | Dykstra . | |
| 5,165,148 | 11/1992 | Fleischer et al. . | |
| 5,257,774 | 11/1993 | Dykstra . | |
| 5,287,602 | 2/1994 | Dykstra . | |
| 5,346,194 | 9/1994 | Coffin, III . | |
| 5,373,642 | 12/1994 | Supe-Dienes . | |
| 5,503,378 | 4/1996 | Schauss et al. . | |
| 5,527,024 | 6/1996 | Dykstra . | |

*Primary Examiner*—David A. Scherbel
*Assistant Examiner*—Lee Wilson
*Attorney, Agent, or Firm*—Dinnin & Dunn, P.C.

[57] ABSTRACT

The clamp is a locked over-center toggle clamp having a toggle lever that actuates a clamp arm between clamped and released positions. An amplification lever is secured to a cam pivot for rotation of the cam pivot inside a base. One end of the clamp arm is pivoted to the cam pivot to act as a follower so that rotation of the cam pivot cams the clamp arm to amplify the hold-down force of the toggle clamp.

28 Claims, 4 Drawing Sheets

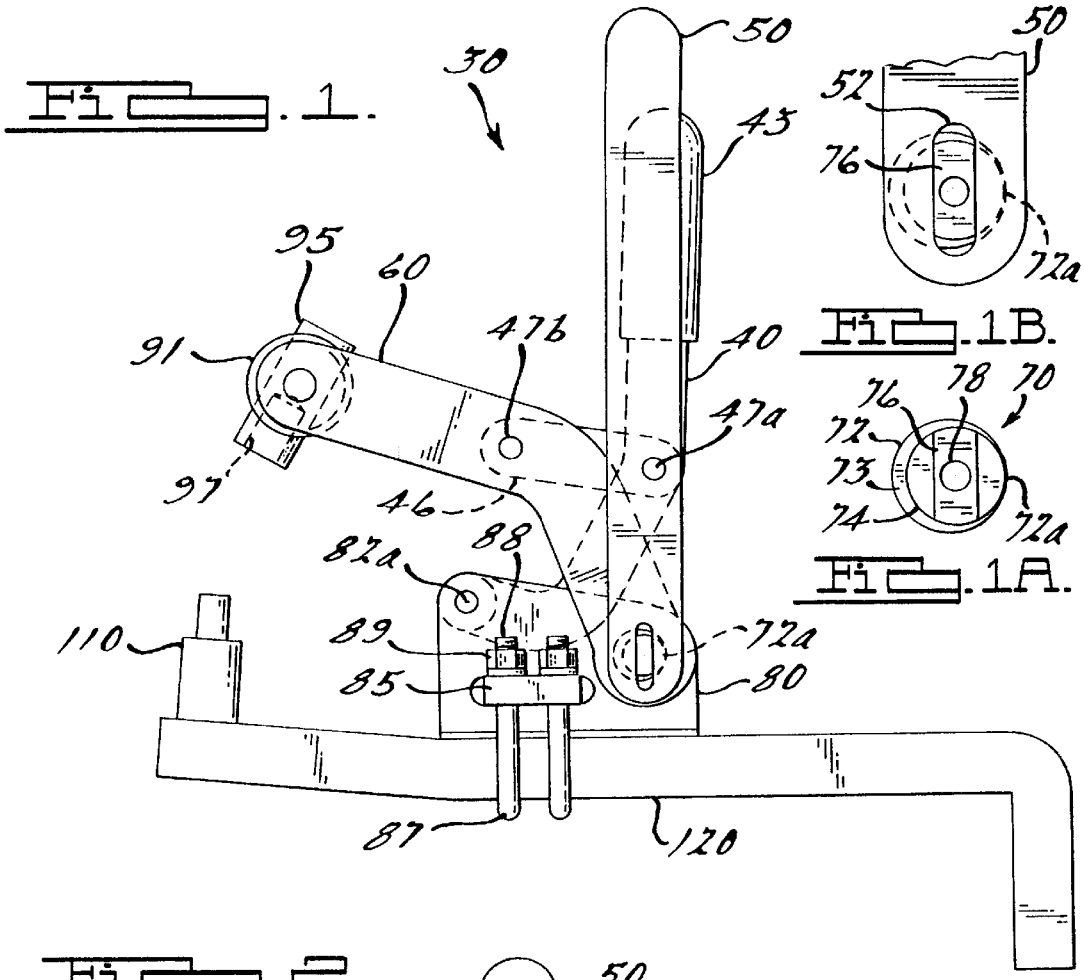
FIG. 1B.
FIG. 1A.
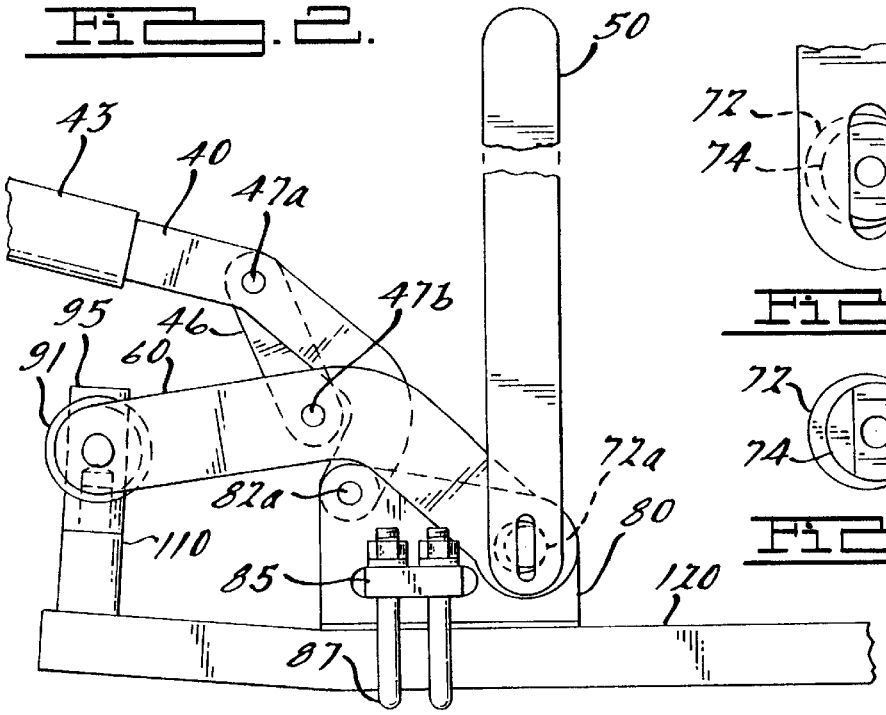
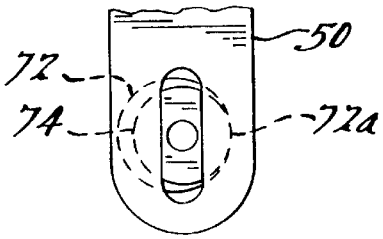
FIG. 2B.
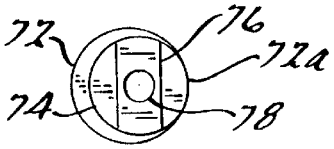
FIG. 2A.

30
40
43
46
47a
47b
50
52
60
70
72
72a
73
74
76
77
78
80
82d
85
87
88
89
91
93
95
96
97
110
120

AMPLIFIED HOLD-DOWN CLAMP

BACKGROUND OF THE INVENTION

1. Field of the Invention

The present invention broadly relates to clamping mechanisms, and more specifically, to toggle clamps that apply hold-down forces.

2. Description of Related Art

Toggle clamps have been used and known in the art for many years. A typical toggle clamp operates through a linkage system of levers and pivots to supply the clamping action and clamping force. The toggle action has an over-center lock point so the clamp cannot move or unlock unless the linkage is moved. All types of toggle clamps have the same toggle action, just oriented differently.

Toggle clamps are typically used to hold work pieces in place for processing and/or clamping two objects to one another, or for clamping an object to a work table or area. Toggle clamps generally are quickly engageable and disengageable with the work piece or object being held to provide a considerable holding or clamping force in order to hold the work piece or objects securely where needed.

The maximum clamping or exerting force developed by any toggle action clamp is attained when the three pivot points of the mechanism are in a straight line. However, this positioning of the pivot points makes no allowance for vibration and intermittent load conditions found in industrial applications, i.e., conditions which would unlock the clamp. Therefore, the typical positioning of the pivot points to produce the maximum holding force has one pivot point just past a plane established by the other two pivot points.

The typical mechanical advantage of a toggle clamp, that is, the correlation between the hold-down force in the clamped position and the force applied to the handle by a person, is on the order of 5 to 1. Accordingly, a force of 40 lbs. applied to handle (a person generally would be incapable of apply a greater force) would result in a hold-down force of 200 lbs. for a clamp with a 5 to 1 mechanical advantage. Any application needing a clamping force greater than approximately 200 lbs would require a pneumatically or hydraulically powered clamp which can apply a much greater initial force to the clamp than the average person. Many industrial applications require a clamping force greater than 200 lbs. thereby preventing the use of a simple, manually-operated toggle clamp.

Pneumatically or hydraulically powered clamps are complicated in design, relative to manually-operated clamps, causing manufacture and maintenance of these clamps to be an expensive proposition, particularly considering that each powered clamp needs a continuous source of power with the attendant design, manufacture and maintenance expenses. Conversely, a manually-operated clamp typically has a design that can be manufactured from an inexpensive stamping process and requiring no maintenance.

Consequently, there has been a longstanding need in the relevant art to produce a manually-operated toggle clamp that produces a clamped force in the range of pneumatically and hydraulically powered clamps.

Wherefore, it is an object of the present invention to provide a toggle clamp having a mechanical advantage greater than the typical manually-operated toggle clamp.

Another object of the present invention is to provide a manually-operated toggle clamp that produces a clamped force in the range of clamp forces produced by pneumatically powered clamps.

Still another object of the present invention is to provide a manually-operated toggle clamp that produces a clamped force in the range of clamp forces produced by hydraulically powered clamps.

Additional objects, advantages and novel features of the invention will be set forth in part in a description which follows, and in part will become apparent to those skilled in the art upon examination of the following specification, or may be learned by practice of the invention herein. The objects and the advantages of the invention may be realized and attained by means of the instrumentalities and combinations particularly pointed out in the appended claims.

SUMMARY OF THE INVENTION

According to the present invention, the foregoing and other objects and advantages are attained by a toggle clamp having a toggle lever that actuates a clamp arm between clamped and released positions. A unique amplification system is secured to a cam pivot associated with the clamping mechanism for rotation of the cam pivot inside a base. One end of the clamp arm is pivoted to the cam pivot to act as a follower so that rotation of the cam pivot cams the clamp arm to uniquely amplify the hold-down force of the toggle clamp.

Other objects, features and advantages of the present invention will become apparent from the subsequent description and appended claims taken in conjunction with the accompanying drawings.

BRIEF DESCRIPTION OF THE DRAWINGS

FIG. 1 shows a clamp according to the present invention in the released position.

FIG. 1A shows the orientation of a unique and newly discovered cam pivot with the clamp in the released position.

FIG. 1B shows the orientation of the cam pivot and its associated amplification lever with the clamp in the released position.

FIG. 2 shows a clamp according to the present invention in the initially clamped position (but not yet in the amplified clamped position).

FIG. 2A shows the orientation of the cam pivot with the clamp in the initially clamped position.

FIG. 2B shows the orientation of the cam pivot and the amplification lever with the clamp in the initially clamped position.

Figures 3, 3A, 3B, 4, 5, 6, 7, 8, 9:
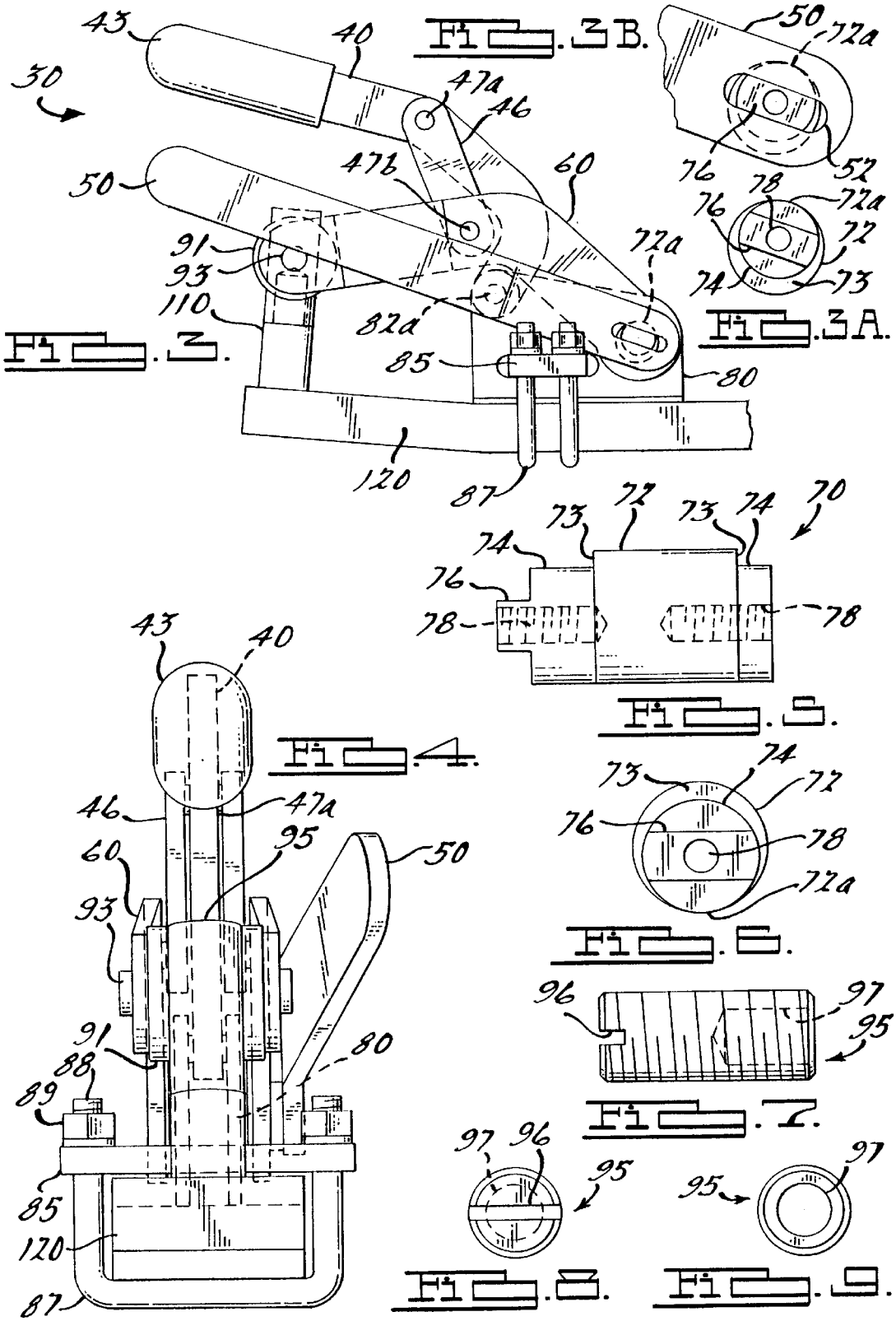
FIG. 3 shows a clamp according to the present invention in the amplified clamped position.
FIG. 3A shows the orientation of the cam pivot with the clamp in the amplified clamped position.
FIG. 3B shows the orientation of the cam pivot and the amplification lever with the clamp in the amplified clamped position.
FIG. 4 shows a front view of FIG. 3 for the clamp according to the present invention.
FIG. 5 shows a side view of the cam pivot cylinder used in FIGS. 1–4.
FIG. 6 shows an end view of the cam pivot from the left side of FIG. 5.
FIG. 7 shows a side view of the hold-down member used in FIG. 1.
FIG. 8 shows an end view of the hold-down member from the left side of FIG. 7.
FIG. 9 shows an end view of the hold-down member from the right side of FIG. 7.

BEST MODE OF CARRYING OUT THE INVENTION AND DESCRIPTION OF THE PREFERRED EMBODIMENTS

Referring to the drawings, the new amplified hold-down toggle clamp apparatus is shown in FIGS. 1, 2, 3 and 4. The clamp is a locked over-center toggle clamp with a clamp arm pivoted on a cam pivot. Upon rotation of a special cam pivot cylinder (to be described), the clamp arm is uniquely cammed to greatly amplify the hold-down force of the toggle clamp. The various parts of the clamp will first be described, followed by a description of how the parts are connected to form the clamp, and finally, the operation of the clamp will be described. Throughout this specification, like element numbers are used to describe the same parts throughout the various drawing figures referred to.

FIG. 1 shows a clamp 30 in the released position having a clamp lever 40 and amplification lever 50 in vertical positions, with a clamp arm 60 resting above a stud 110 to which a clamp force is to be applied. FIG. 2 shows the clamp 30 in the clamped position with the clamp arm 60 engaging the stud 110 with the toggle lever 40 being rotated toward the stud 110 until the pivoted linkage is in a locked over-center toggled position. FIG. 3 shows the clamp 30 in the amplified position with the amplification lever 50 rotated from the vertical position also toward the stud 110 to greatly amplify the linear force on stud 110.

Figure 20:
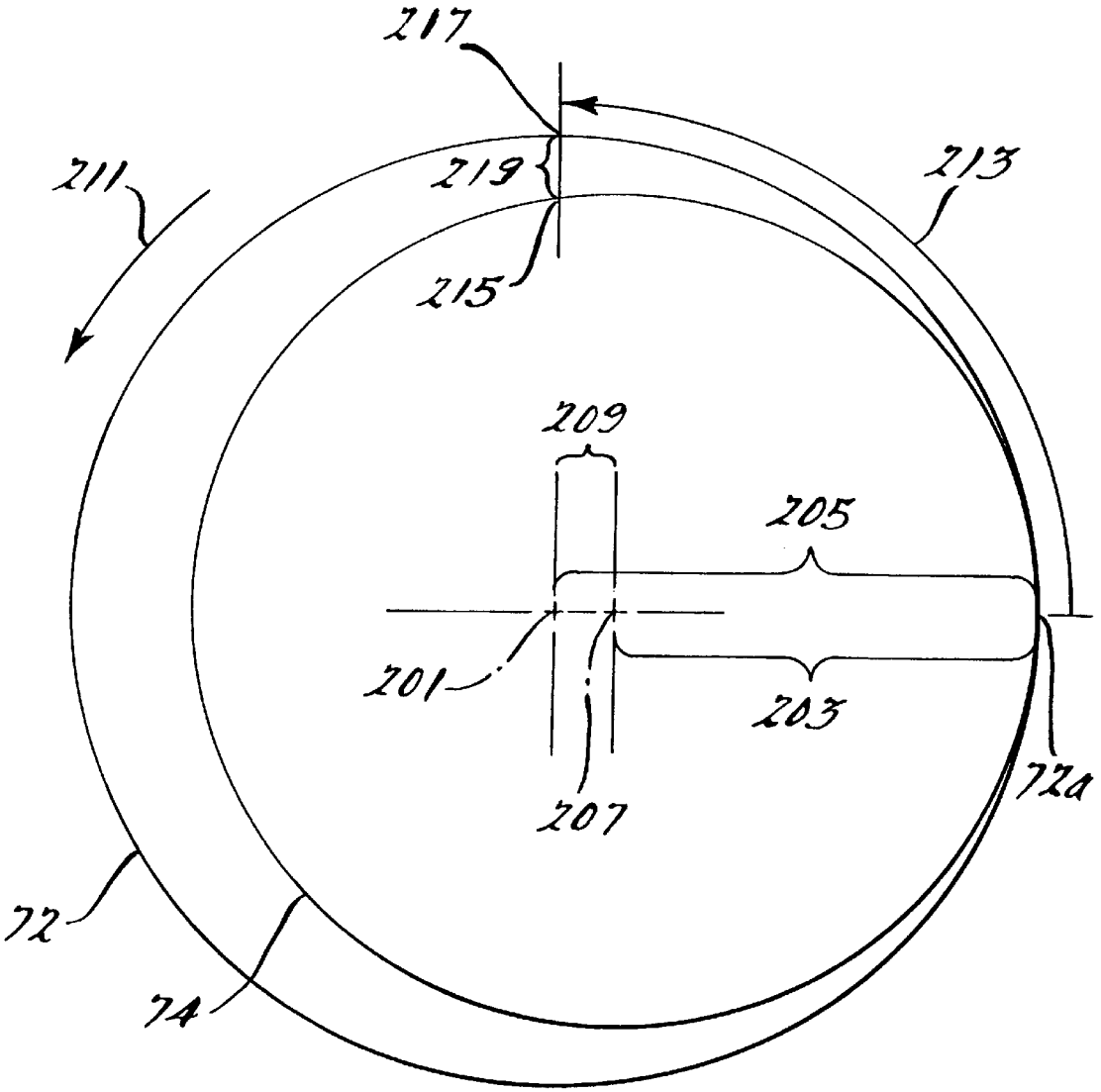
FIG. 20 shows an enlarged exaggerated view of the cam pivot cylinder of FIG. 6 to further illustrate how the camming action is carried out.

A cam pivot or cam pivot cylinder 70, as illustrated in FIGS. 5, 6 and 20, has cylindrical portions with differing diametric dimensions. The larger central portion is a pivot portion 72 and the two smaller, laterally-extending portions are camming surfaces or cams 74. The cams 74 are concentric relative to one another, but are nonconcentric relative to the pivot portion 72. The design of the cam pivot 70 is to have the cams 74 positioned relative to the pivot portion 72 such that a point of the exterior surfaces of the cams 74 and pivot portion 72 intersect establishing a congruent linear edge 72*a* the length of the cam pivot 70. One cam 74 has a lateral ridge portion 76 which is the gripping surface for the lever arm 50. Each end of the cam pivot 70 has a longitudinally threaded bore 78 so it can be secured in place by fasteners (now shown).

Figure 17:
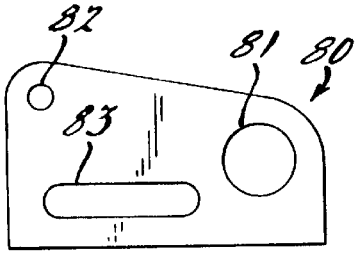
FIG. 17 shows an elevation view of the base member used FIGS. 1–4.

A base plate 80 is illustrated in FIGS. 1 and 17 having a plurality of orifices, two circular 81, 82 and one oblong 83. The clamp of the present invention includes two base plates 80 erected parallel to one another with the orifices aligned. The larger circular orifice 81 receives the pivot portion 72 of the cam pivot 70 to rotatably secure the cam pivot 70 between the base plates 80. The smaller circular orifices 82 of the base plates 80 receives a cross pin 82*a* (FIG. 2) to provide a pivot for the toggle lever 40.

Figure 16:
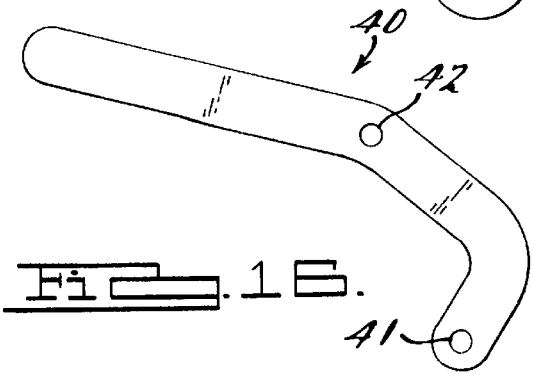
FIG. 16 shows a side view of the toggle lever used in FIGS. 1–4.

The preferred embodiment of the toggle lever 40, as illustrated in FIG. 16, is a bifurcated oblong section of steel with appropriate bends to provide a toggled over-center lock when the clamp 30 is in the clamped position. The toggle lever 40 has two circular orifices 41, 42 to receive cross pins 82*a* and 47*a* (FIG. 3) for pivotal engagement. One orifice 41 is located at one end of a toggle lever 40 to receive cross pin 82*a* to pivotally anchor the toggle lever 40 between the base plates 80, and the second orifice 42 is centrally located on the toggle lever 40 for connection with cross pin 47*a*. Since the toggle lever 40 pivots between the base plates 80, the width of the toggle lever 40 generally determines the spacing between the base plates 80. However, with the use of spacers and/or washers, any desired width of the clamp 30 may be achieved. This embodiment of the toggle lever 40 includes a grip member 43 (at the end opposite the orifice 41) made of soft foam rubber or plastic material for ease of gripping.

Figure 11:
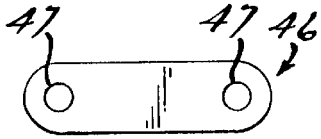
FIG. 11 shows a side view of a link member used in FIG. 1.

A link member 46, as illustrated in FIGS. 2 and 11, is a straight section of steel with circular orifices 47 at each end to receive cross pins 47*a*, 47*b* (FIG. 2). Two link members 46 (FIG. 4) are aligned and pivoted to either side of the toggle lever 40 at the second orifice 42 in the toggle lever 40. The second orifice 47 of each link member 46 is pivoted to the inside face of the clamp arm 60.

Figure 10:
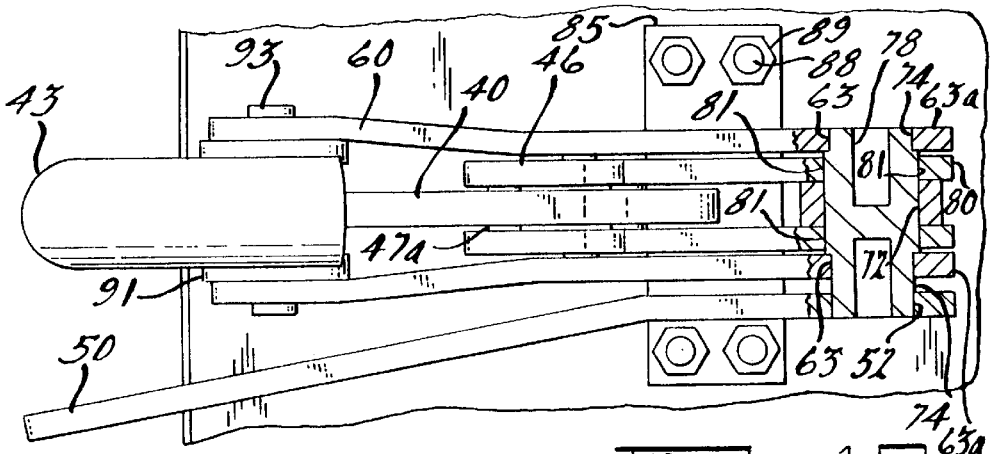
FIG. 10 shows a top view of the clamp according to the present invention in the amplified clamped position of FIG. 3, with a partial sectional view of the cam pivot area.
Figure 13:
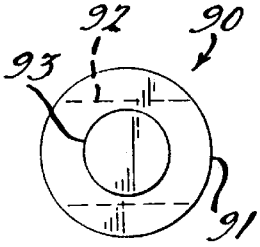
FIG. 13 shows an end view of the pivot referred to in FIG. 12.
Figure 12:
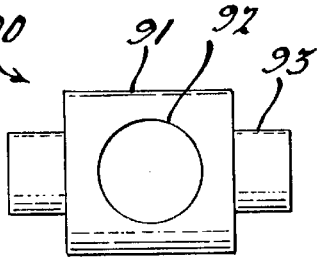
FIG. 12 shows a side view of the pivot for the hold-down member used in FIG. 1 and FIG. 10.
Figure 15:
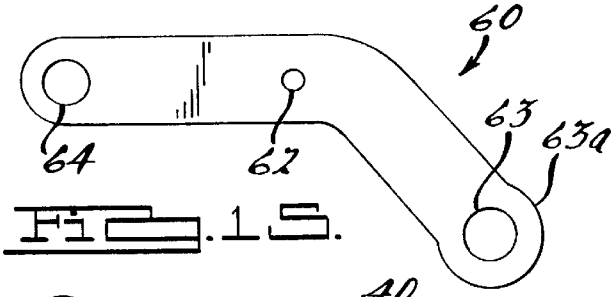
FIG. 15 shows a side view of the clamp arm members used in FIGS. 1–4.

The clamp arm 60, as illustrated in FIGS. 1 and 15, is another oblong section of steel with a centrally angled design approximating a 45° angle. The clamp arm 60 has three circular orifices, two at each end with a smaller, centrally located orifice 62 to receive the cross pin 47*b* at the left side orifice 47 of the link member 46. Accordingly, the clamp arm 60 is pivotally connected to the toggle lever 40 via the link member 46. One end orifice 63 of the clamp arm 60 slides over the cam surface 74 of the cam pivot 70 until the inner face of the clamp arm 60 rests against a vertical face 73 of the larger diameter pivot portion 72 of the cam pivot 70. The clamp of the present invention includes two clamp arms 60 (see FIG. 4) parallel and aligned to one another, and each pivoted on the cams 74 on opposing sides of the pivot portion 72 of the cam pivot 70 (FIGS. 5 and 10). The second orifice 64 at the opposite end of the clamp arm 60 receives a specially designed hold-down pivot member 90 as illustrated in FIGS. 1, 12 and 13.

The hold-down pivot member 90 has a cylindrical body 91 with a threaded bore 92 and pivot arms 93 laterally extending on each side of the cylindrical body 91. The pivot arms 93 rest in the opposing orifices 64 of the clamp arms 60. The threaded bore 92 of the hold-down pivot member 90 receives a hold-down mechanism 95 illustrated in FIGS. 7–9. The hold-down mechanism 95 is cylindrical with a threaded exterior, one end being notched at 96 and the opposite end having a bore 97 extending longitudinally generally half the length of the hold-down mechanism 95.

The preferred embodiments of the hold-down pivot member 90 and hold-down mechanism 95 are dielectric materials, for example, nonconducting plastic, Delrin or nylon, to insulate the amplified hold-down clamp 30 from the passage of current. However, it should be noted that any design and material for the hold-down pivot member 90 and hold-down mechanism 95 may be used, depending on the particular requirements of the working environment of the clamp 30 and the structure of the objects needing to be clamped.

Figure 14:
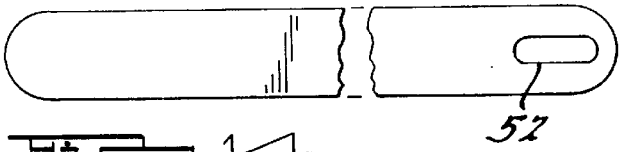
FIG. 14 shows a side view of the amplification lever used in FIG. 1.

The amplification lever 50, as illustrated in FIGS. 1 and 14, is an oblong length of steel with an oblong orifice 52 at one end to slidingly engage the corresponding oblong lateral ridge 76 of the cam pivot 70 (see FIGS. 5–6). It should be noted that the configuration of the orifice 52 in the amplification lever 50 and ridge 76 on the cam pivot 70 may have any design, as long as the rotation of the amplification lever 50 functions to rotate the cam pivot 70 inside the base plates 80. A section of the amplification lever 50 is angled away from the clamp 30 perpendicular to its longitudinal axis (see FIG. 4) to provide room for hand engagement.

Figure 18:
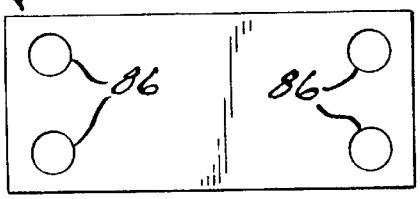
FIG. 18 shows a plan view of the securing plate used in FIGS. 1–4.
Figure 19:
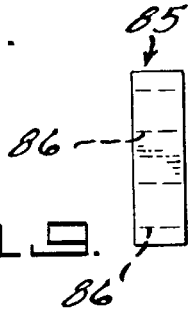
FIG. 19 shows an end view of the securing plate of FIG. 18.

FIGS. 1 and 18–19 illustrate a rectangular securing plate 85 having four circular orifices 86 in each corner. The clamp 30 of the present invention is designed to be secured to a metal or copper bar 120 (shown in FIGS. 1–3). Accordingly, the securing plate 85 is positioned through the oblong orifices 83 aligned in the erect base plates 80. The securing plate 85 has dimensions which extend past two orifices 83 on each side of the copper bar 120. The orifices 86 receive the threaded ends 88 of U-bolts 87 parallel to one another along the longitudinal axis of the securing plate 85. Nuts 89 on the threaded ends 88 of the U-bolts 87 secure the clamp 30 to a support member, such as copper bar 120.

The threaded bores 78 of the cam pivot 70 receive bolts (not shown), and any necessary washers (not shown), to secure the amplification lever 50, the clamp arms 60 and the base plate 80 to the cam pivot 70.

In operation, the amplified hold-down clamp begins in the released position of FIG. 1, with the toggle lever and amplification lever in upright positions and the holddown mechanisms resting above a stud 110 (shown in FIGS. 1–3). The stud at the end of the copper bar has two portions with different dimensions, the top portion having the smallest. And in one example, usage of this invention has an automobile bumper (not shown) placed on the stud to be immersed in a chrome solution for a chrome plating process.

The toggle lever 40 is rotated toward the stud 110 about the cross pin 82*a* in the base plates (hereinafter "first pivotal axis"). With the link member 46 pivoted to the toggle lever at cross pin 47*a* (hereinafter "second pivotal axis") and to the clamp arm 60 at cross pin 47*b* (hereinafter "third pivotal axis"), the motion of the toggle lever 40 rotates the clamp arm 60 about the cam pivot to move the hold-down mechanism toward the stud. The motion of the toggle lever stops once the hold-down mechanism engages the stud to slip over the smaller portion of the stud to clamp a bumper (not shown) readied for the chrome plating process. In this position, the first, second and third pivotal axes are locked in an over-center toggled position established by the third pivotal axis located on one side of a plane established by the first and second pivotal axes, and the hold-down mechanism is positioned on the opposite side of the plane. In this initial clamped position, the amplified toggle clamp 50 is still in the upright position as illustrated in FIG. 2. At this stage, the mechanical advantage between the pressure applied to the stud by the hold-down mechanism relative to the pressure applied to the toggle lever is on the order of approximately 5:1. For example, a manual 40 lbs. pressure applied to the toggle lever would result in a linear clamping pressure at the stud of 200 lbs, as is typical for most manually-operated toggle clamps.

Next, the amplification lever 50 is rotated toward the stud 110. This movement of the amplification lever rotates the cams 74 of the cam pivot 70 about the axis of the pivot portion (explained in more detail with respect to FIG. 20 below). With the orifices 63 of the clamp arms 60 positioned over the cams to act as cam followers, the end 63*a* of the clamp arm rotates upward and slightly toward the stud. This movement has been discovered to greatly increase the force in the clamp arm and pivotal linkage to uniquely amplify the linear force applied to the stud by the clamping or hold-down mechanism. The values for the amplified linear force has been determined to range from 1,500 lbs. to 2,000 lbs. which is a mechanical advantage range of 37.5:1 to 50:1 for an initial 40 lbs. pressure applied to the amplification lever 50.

FIG. 20 is an exaggerated and enlarged drawing of the cam pivot 70 to further illustrate the camming action on the clamp arm 60 upon rotation of the cam pivot 70 by the amplification lever 50 (the clamp arm 60, amplification lever 50 and the lateral ridge 76 are not shown for clarity). The orientation of the cam pivot 70 in FIG. 20 is before the rotation of the amplification lever 50, the same orientation as illustrated in FIGS. 1 and 2, with the congruent linear edge 72*a* generally in a 3 o'clock position.

The pivot portion 72 is rotatably held inside orifice 81 of the base plate 80 to establish an axis of rotation 201 for the cam pivot 70. The orifice 63 of the clamp arm 60 engages the cam pivot 70 to slidingly engage and rest against the cylindrical surfaces of cams 74. With the cams 74 having a smaller radius 203 than the radius 205 of the pivot portion 72 as well as being designed nonconcentric relative to one another, the center axis 207 of the cams 74 is a distance 209 from the rotation axis 201.

In this orientation of the cam pivot 70, the amplification lever 50 rotates the cam pivot 70 counterclockwise (as shown at 211) approximately 90° as illustrated at 213 (the range of the amplification lever 50 is generally 0° to 90°). The center axis 207 of the cams 74 rotates counterclockwise about the axis of rotation 201 and the congruent linear edge 72*a* moves from the initial 3 o'clock position to the 12 o'clock position. Since the congruent linear edge 72*a* extends the length of the cam pivot 70, including the cams 74, there is always a point of contact between the orifice 63 of the clamp arm 60 and the congruent linear edge 72*a*.

This point of contact at the 12 o'clock position between the orifice 63 of clamp arm 60 and the cam 74 will be described, before and after rotation of cam pivot 70, to illustrate the camming action. Before rotation, this point of contact between orifice 63 and cam 74 is established at point 215, the exterior surface of cam 74 on which orifice 63 acts as a follower. After rotation of the cam pivot 70 approximately 90°, the congruent linear edge 72*a* will rotate from the 3 o'clock position to the 12 o'clock position establishing a new point 217 of contact between the orifice 63 and cam 74. As illustrated in FIG. 20, the point of contact has moved a distance 219 from point 215 to point 217. This is the camming distance with the orifice 63 having moved a distance 219, and correspondingly, the end 63*a* of the clamp arm 60 having moved the same distance.

Accordingly, the end 63*a* of the clamp arm 60 will be cammed vertically a distance 219 from point 215 to point 217 at this contact point positioned at 12 o'clock. This upward camming action of end 63*a* further pivots the clamp arm 60 about cross pin 47*b* (the pivotal connection between the clamp arm 60 and link member 46) to force the opposite end of the clamp arm 60 downward with an amplified force. Additionally, the upward camming action of end 63*a* increases the toggle effect of pivots 47*a*, 47*b* and 82*a* by slightly forcing pivot 47*b* up and away from the hold-down mechanism 95 while simultaneously forcing pivot 47*a* slightly down and toward the hold-down mechanism 95. This pivot action increases the locked over-center position of pivots 47*a*, 47*b* and 82*a* by moving pivot 47*a* farther away from a line established by pivots 47*b* and 82*a*. Increasing the locked over-center position results in an amplified downward force at the hold-down mechanism 95.

It should be noted that any design of a cam that moves the end of the clamp arm in the manner just described would have the same result, for example, a variable radius design such as an oval-shaped extension, or an arcuate-shaped extension, both laterally projecting from a pivot portion. Additionally, clamps could be designed having the cams positioned at the first or third pivotal axes to provide the amplified clamped forces. The present cam pivot was designed to simplify manufacturing thereby decreasing the cost to produce the clamping mechanism.

A practitioner in the art can readily understand the unique significance of this invention. A toggle clamp having a mechanical advantage in the range of 37.5:1 to 50:1 creates a final resultant force that equals or surpasses the range of resultant forces available with typical pneumatically powered clamps (which are considerably more expensive) and enters the lower range of resultant forces established by hydraulically powered clamps (which are also much more expensive). Accordingly, this invention can be used in applications routinely carried out by pneumatic clamps and some hydraulic clamps. Since manual toggle clamps are simple in design, economical to manufacture, and easy to use, there is a great advantage to using a manually operated toggle clamp, as opposed to a pneumatically or hydraulically powered clamp having the attendant complicated design, expense to manufacture and use, and maintenance problems.

While the present invention has been described in an illustrative manner, it is to be understood that the terminology which has been used is intended to be in the nature of words of description rather than of limitation.

Many modifications and variation of the present invention are possible in light of the above teachings. Therefore, within the scope of the appended claims, the present invention may be practice otherwise than as specifically described.

What is claimed is:

1. An amplified hold-down toggle clamp comprising:

a toggle means for actuating a clamp arm between clamped and released positions, said clamp arm including one end pivoted to a base;

a toggle lever having one end pivoted to said base;

a link member pivotally connecting said clamp arm to said toggle lever for locked-over-center cooperation in said clamped position;

a cam pivot rotatable held in said base and providing the pivotal connection of said clamp arm to said base, said cam pivot including a cam portion having a cam surface on which the end of said clamp arm pivots and acts as a follower of the cam surface; and a rotating means to rotate said cam pivot in said base.

2. The amplified hold-down toggle clamp of claim 1 wherein said cam pivot has two cylindrical portions with different diameters, a cylindrical pivot portion rotatably held in said base and said cam portion being cylindrical.

3. The amplified hold-down toggle clamp of claim 2 wherein said pivot and cam portions are nonconcentric.

4. The amplified hold-down toggle clamp of claim 3 wherein said pivot and cam portions extend laterally from each other having a section of exterior surfaces congruent.

5. The amplified hold-down toggle clamp of claim 2 wherein said cam portion has a smaller diameter than said pivot portion.

6. The amplified hold-down toggle clamp of claim 5 wherein said clamp arm has an orifice at one end to be secured to said cam portion of said cam pivot.

7. The amplified hold-down toggle clamp of claim 1 wherein said rotating means is a lateral extension of said cam pivot designed to receive an amplification lever for rotating said cam pivot.

8. The amplified hold-down toggle clamp of claim 1 wherein:

said toggle lever pivotally connected to said base establishes a first pivotal axis;

said link member pivotally connected to said toggle lever establishes a second pivotal axis, and the opposite end of said link member pivotally connected to said clamp arm establishes a third pivotal axis; and a hold-down means pivotally connected to the end of said clamp arm opposite the cam pivot.

9. The amplified hold-down toggle clamp of claim 8 wherein said clamped position is a locked over-center position established by the toggle lever rotating about the first pivotal axis until the third pivotal axis is located on one side of a plane established by the first and second pivotal axes, and the hold-down means is positioned on the opposite side of the plane.

10. The amplified hold-down toggle clamp of claim 8 wherein said hold-down means is cylindrical having a longitudinal axis perpendicular to a pivotal axis, said hold-down means having a notched end with the opposite end having a longitudinal bore extending less than the entire length, said hold-down means having exterior threads.

11. The amplified hold-down toggle clamp of the claim 8 wherein said hold-down means is a dielectric material.

12. An amplified hold-down toggle clamp comprising:

a base;

a toggle lever pivotally connected to said base establishing a first pivotal axis;

a clamp arm actuated by said toggle lever between clamped and released positions, one end of said clamp arm having an orifice;

a link member pivotally connected to said toggle lever establishing a second pivotal axis with the opposite end of said link member pivotally connected to said clamp arm establishing a third pivotal axis;

a hold-down means pivotally connected to the end of said clamp arm opposite said orifice;

a cam pivot rotatably held in said base, said cam pivot having a cam portion to receive said clamp arm at the orifice; and said cam portion has a portion extending laterally to receive an amplification lever for rotating said cam pivot.

13. The amplified hold-down toggle clamp of claim 12 wherein said cam pivot has two cylindrical portions with different diameters, one a pivot portion to rotatably secure said cam pivot to said base, and the second is said cam portion.

14. The amplified hold-down toggle clamp of claim 13 wherein said pivot and cam portions are nonconcentric.

15. The amplified hold-down toggle clamp of claim 13 wherein said pivot and cam portions extend laterally from each other having a section of exterior surfaces congruent.

16. The amplified hold-down toggle clamp of claim 13 wherein said cam portion has a smaller diameter than the pivot portion.

17. The amplified hold-down toggle clamp of claim 12 wherein said clamped position is a locked over-center position established by the toggle lever rotating about the first pivotal axis until the third pivotal axis is located on one side of a plane established by the first and second pivotal axes, and the hold-down means is positioned on the opposite side of the plane.

18. The amplified hold-down toggle clamp of claim 12 further said hold-down means is a cylindrical dielectric material having a longitudinal axis perpendicular to said pivotal axis, said hold-down means having a notched end with the opposite end having a longitudinal bore extending less than the entire length, said hold-down means having exterior threads.

19. An amplified hold-down toggle clamp comprising:

a base;

a toggle lever pivotally connected to said base establishing a first pivotal axis;

a clamp arm actuated by said toggle lever between clamped and released positions, one end of said clamp arm having an orifice;

a link member pivotally connected to said toggle lever establishing a second pivotal axis with the opposite end of said link member pivotally connected to said clamp arm establishing a third pivotal axis;

a hold-down means pivotally connected to the end of said clamp arm opposite said orifice; and a cam pivot rotatably held in said base, said cam pivot has two cylindrical portions extending laterally from one another, one a pivot portion rotatably held in said toggle means and the second a cam portion to receive said clamp arm at the orifice, the two portions are nonconcentric having a section of exterior surfaces congruent with the cam portion having a smaller diameter of the two portions.

20. The amplified hold-down toggle clamp of claim 19 wherein said pivot cam includes two cylindrical cam portions extending laterally on opposing sides of said pivot portion.

21. The amplified hold-down toggle clamp of claim 20 further including two clamp arms, each aligned with the other, one on each cam portion of said cam pivot.

22. The amplified hold-down toggle clamp of claim 21 wherein said pivot of the hold-down means comprising two symmetrical, cylindrical pivots extending laterally aligned on opposing sides of a larger cylindrical portion, said larger cylindrical portion having a threaded bore perpendicular to the pivot axis, said threaded bore to receive the hold-down means, said cylindrical pivots extend through opposing circular orifices in said clamp arms.

23. The amplified hold-down toggle clamp of claim 22 wherein said hold-down means is cylindrical having exterior threads the length of said hold-down means to be positioned in the threaded bore of said pivot, said hold-down means having a notched end and the opposite end having a bore extending less than the entire length.

24. The amplified hold-down toggle clamp of claim 19 wherein said base comprising two symmetric plates positioned erect and adjacent each other, each plate having opposed and aligned orifices, one circular orifice for the pivot to the toggle lever, a second circular orifice to receive the pivot portion of said cam pivot, and an oblong orifice to receive a rectangular securing plate, said securing plate having dimensions to extend two corners past each exterior wall of said base plates, each corner having a circular orifice to receive threaded ends of two U-bolts, each U-bolt parallel to one another along the longitudinal axis of said securing plate, each threaded end receiving nuts for securing the base to a support.

25. An amplified hold-down toggle clamp apparatus comprising:

toggle linkage members which actuate a clamp arm from an open position to an initially closed position having an initial clamping force, said toggle linkage members having first, second, and third pivotal axes associated therewith, a cam pivot member rotatably held in a base, said cam pivot member having a cam portion with said clamp arm having one portion thereof in contact with said cap portion to act as a follower for significantly increasing the clamping force of said toggle means in its clamped position over and above said initial clamping force, and a rotation means to rotate said cam pivot in said base to provide the camming action on said clamp arm by said cam portion.

26. The amplified hold-down toggle clamp of claim 25 wherein said initially clamped position is a locked over-center position established by the toggle lever rotating about the first pivotal axis until the third pivotal axis is located on the one side of a plane established by the first and second pivotal axes to establish the initial clamping force.

27. An amplified hold-down toggle clamp apparatus comprising:

toggle linkage members which actuate a clamp arm from an open position to an initially closed position having an initial clamping force, said toggle linkage members having first, second, and third pivotal axes associated therewith, a cam pivot member rotatably held in said toggle means, said cam pivot member having a cam portion with said clamp arm having one portion thereof in contact with said cam portion to act as a follower for significantly increasing the clamping force of said toggle means in its clamped position over and above said initial clamping force;

said initially clamped position is a locked over-center position established by the toggle lever rotating about the first pivotal axis until the third pivotal axis is located on the one side of a plane established by the first and second pivotal axes to establish the initial clamping force;

said cam pivot has a portion extending laterally to receive an amplification lever for rotating said cam pivot.

28. An amplified hold-down toggle clamp apparatus comprising:

toggle linkage members which actuate a clamp arm from an open position to an initially closed position having an initial clamping force, said toggle linkage members having first, second, and third pivotal axes associated therewith, a cam pivot member rotatable held in said toggle means, said cam pivot member having a cam portion with said clamp arm having one portion thereof in contact with said cam portion to act as a follower for significantly increasing the clamping force of said toggle means in its clamped position over and above said initial clamping force;

said initially clamped position is a locked over-center position established by the toggle lever rotating about the first pivotal axis until the third pivotal axis is located on the one side of a plane established by the first and second pivotal axes to establish the initial clamping force, said cam pivot has a portion extending laterally to receive an amplification lever for rotating said cam pivot, said amplification lever having an orifice to receive said lateral extension from said pivot.

* * * * *